US011168503B2

(12) United States Patent
Demiroez et al.

(10) Patent No.: US 11,168,503 B2
(45) Date of Patent: Nov. 9, 2021

(54) COOLING DEVICE HAVING A DOOR CLOSING ASSISTANT

(71) Applicant: BSH HAUSGERAETE GMBH, Munich (DE)

(72) Inventors: Taha Demiroez, Tekirdag (TR); Emre Guentav, Istanbul (TR); Rasit Oenver, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 781 days.

(21) Appl. No.: 15/995,169

(22) Filed: Jun. 1, 2018

(65) Prior Publication Data

US 2019/0003220 A1 Jan. 3, 2019

(30) Foreign Application Priority Data

Jun. 30, 2017 (TR) ..... 2017/09671

(51) Int. Cl.

| | |
|---|---|
| ***E06B 7/00*** | (2006.01) |
| ***E05F 1/16*** | (2006.01) |
| ***E05C 19/14*** | (2006.01) |
| ***E05B 17/00*** | (2006.01) |
| ***E05B 65/00*** | (2006.01) |
| ***E05C 19/02*** | (2006.01) |
| *F25D 23/02* | (2006.01) |
| *F25D 25/02* | (2006.01) |

(52) U.S. Cl.

CPC ..... *E05F 1/16* (2013.01); *E05B 17/0025* (2013.01); *E05B 65/0046* (2013.01); *E05C 19/024* (2013.01); *E05C 19/14* (2013.01); *E05Y 2201/266* (2013.01); *E05Y 2201/426* (2013.01); *E05Y 2201/488* (2013.01); *E05Y 2900/31* (2013.01); *F25D 23/028* (2013.01); *F25D 25/025* (2013.01)

(58) Field of Classification Search

CPC .. E05B 17/0025; E05B 65/0046; E05C 19/14; E05C 19/024; E05F 1/16; E05F 15/619; E25D 23/028; E05Y 2900/31; E05Y 2201/426; E05Y 2201/488; E05Y 2600/41; E05Y 2800/23; E05Y 2201/266; F25D 23/028; F25D 25/025; F25D 29/005; F25D 27/02; F25D 25/40

USPC ..... 49/69, 70; 312/405, 405.1

See application file for complete search history.

(56) References Cited

U.S. PATENT DOCUMENTS 5,460,010 A * 10/1995 Kobayashi ..... F25D 17/045 62/187

6,338,536 B1 1/2002 Ueno et al.

(Continued)

FOREIGN PATENT DOCUMENTS

EP 1077354 A2 2/2001

*Primary Examiner* — Chi Q Nguyen

(74) *Attorney, Agent, or Firm* — Laurence A. Greenberg; Werner H. Stemer; Ralph E. Locher

(57) ABSTRACT

A cooling device includes a body, a drawer door attached to the body by rails in a slidable manner, and a door opening assistant for facilitating opening of the drawer door. As an improvement, at least two door closing assistants, that are configured to close the drawer door when the drawer door reaches a predetermined position, are provided on the body and/or the drawer door in such a way that the door opening assistant remains at a location between the at least two door closing assistants.

6 Claims, 5 Drawing Sheets

(56) References Cited

U.S. PATENT DOCUMENTS

| | | | | |
|---|---|---|---|---|
| 8,297,725 | B2 * | 10/2012 | Kim | F25D 23/028 312/405 |
| 8,469,469 | B2 * | 6/2013 | Kim | F25D 23/028 312/405 |
| 9,735,555 | B2 * | 8/2017 | Fishovitz | H02B 1/066 |
| 10,386,111 | B2 * | 8/2019 | Akca | E05B 17/0033 |
| 10,794,629 | B2 * | 10/2020 | Wilson | F25D 17/047 |
| 10,837,214 | B2 * | 11/2020 | Kim | E05F 15/616 |
| 2014/0210328 | A1 * | 7/2014 | Akalan | F25D 23/028 312/326 |
| 2014/0265797 | A1 * | 9/2014 | Scheuring | A47B 51/00 312/404 |
| 2016/0146533 | A1 * | 5/2016 | Jung | A47B 88/447 312/405 |
| 2017/0131016 | A1 * | 5/2017 | Eicher | F25D 25/021 |
| 2018/0187965 | A1 * | 7/2018 | Seo | F25D 25/025 |
| 2018/0259246 | A1 * | 9/2018 | Choi | A47B 88/90 |

* cited by examiner

COOLING DEVICE HAVING A DOOR CLOSING ASSISTANT

CROSS-REFERENCE TO RELATED APPLICATION

This application claims the priority, under 35 U.S.C. § 119, of Turkish application TR 2017/09671, filed Jun. 30, 2017; the prior application is herewith incorporated by reference in its entirety.

BACKGROUND OF THE INVENTION

Field of the Invention

The invention relates to a cooling device having a drawer door attached to a body on rails in a slidable manner, and a door opening assistant for facilitating opening of the drawer door.

Description of the Related Art

Cooling devices may have doors hinged to the body thereof and/or drawer doors connected to the body by rails. Door opening assistants may be provided in order to permit opening of the doors in an easier manner.

European Patent Application EP 1077354, corresponding to U.S. Pat. No. 6,338,536, discloses a door opening device for a food storage apparatus such as a household refrigerator which includes a generally cylindrical coil unit mounted on a body of the storage apparatus and having an axially extending through hole, a plunger mounted in the hole of the coil unit so as to be axially moved with respect to the coil unit, the plunger being moved in a direction when the coil unit is energized, and a pushing member mounted on one axial end of the plunger so as to be moved with the plunger, the pushing member pushing the door in an opening direction against a sticking force of the magnet gasket when moved in the one direction with the plunger.

BRIEF DESCRIPTION OF THE INVENTION

It is accordingly an object of the invention to provide a cooling device having a door closing assistant, which overcomes the hereinafore-mentioned disadvantages of the heretofore-known devices of this general type, which provides an additional improvement, an additional advantage or an alternative to the prior art and which provides a cooling device where the drawer door is opened and/or closed in a balanced manner.

With the foregoing and other objects in view there is provided, in accordance with the invention, a cooling device having a body, a drawer door attached to the body by rails in a slidable manner, and a door opening assistant in order to facilitate opening of the drawer door. Accordingly, at least two door closing assistants, that are configured to close the drawer door when the drawer door reaches a predetermined position, are provided on the body and/or the drawer door in such a way that the door opening assistant remains at a location between the at least two door closing assistants. Thus, the drawer door is opened and/or closed in a balanced manner. Especially in the case of the door opening assistant being positioned at different distances with respect to the side walls of the body, this may lead to unbalanced movement of the drawer during opening and/or closing.

The door closing assistant may catch and close the drawer door and may also keep the drawer door closed until a predetermined force is applied to open the drawer door.

In a possible embodiment of the invention, the drawer door may have at least two door carrier arms linked to the rails and connected to the drawer door. Thus, the drawer door may be connected to the rails in a stable manner. The door carrier arms provide a large area to be connected to the rails. That is not only but especially advantageous for heavy doors.

In a possible embodiment of the invention, a catching pin may be provided on each one of the at least two door carrier arms in order to be held by each one of the at least two door closing assistants. Thus, the door closing assistant can hold the drawer door through the catching pin, especially without disturbing the operation of the rails.

In a possible embodiment of the invention, each one of the at least two door closing assistants may include at least one holder element for catching the catching pin. Thus, the door closing assistant can hold the catching pin.

In a possible embodiment of the invention, the holder element may include at least one first arm and at least one second arm extending in a manner defining a housing in between having a size corresponding to the catching pin. Thus, the holder element can grab and hold the catching pin almost circumferentially.

In a possible embodiment of the invention, in order to facilitate insertion of the catching pin into the housing during opening and/or closing of the drawer door, either one of the first arm and the second arm may be provided to be longer than the other one. Thus, the catching and insertion of the catching pin between the first arm and the second arm is facilitated.

In a possible embodiment of the invention, each one of the at least two door closing assistants may include a closing assistant body and at least one pin providing a connection of the holder element to the closing assistant body. Thus, the assembly of the holder element is realized so as to have rotational freedom.

In a possible embodiment of the invention, at least one cocking spring is provided for fixing the holder element at a predetermined open position. Thus, when the drawer door is opened, the holder element waits ready to grab and pull the catching pin, so to close the drawer door.

In a possible embodiment of the invention, at least one spring may be provided in a manner guiding the holder element to a predetermined closed position. Thus, when the holder element is released from the cocking spring, the drawer door is drawn to the closed position.

Other features which are considered as characteristic for the invention are set forth in the appended claims.

Although the invention is illustrated and described herein as embodied in a cooling device having a door closing assistant, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
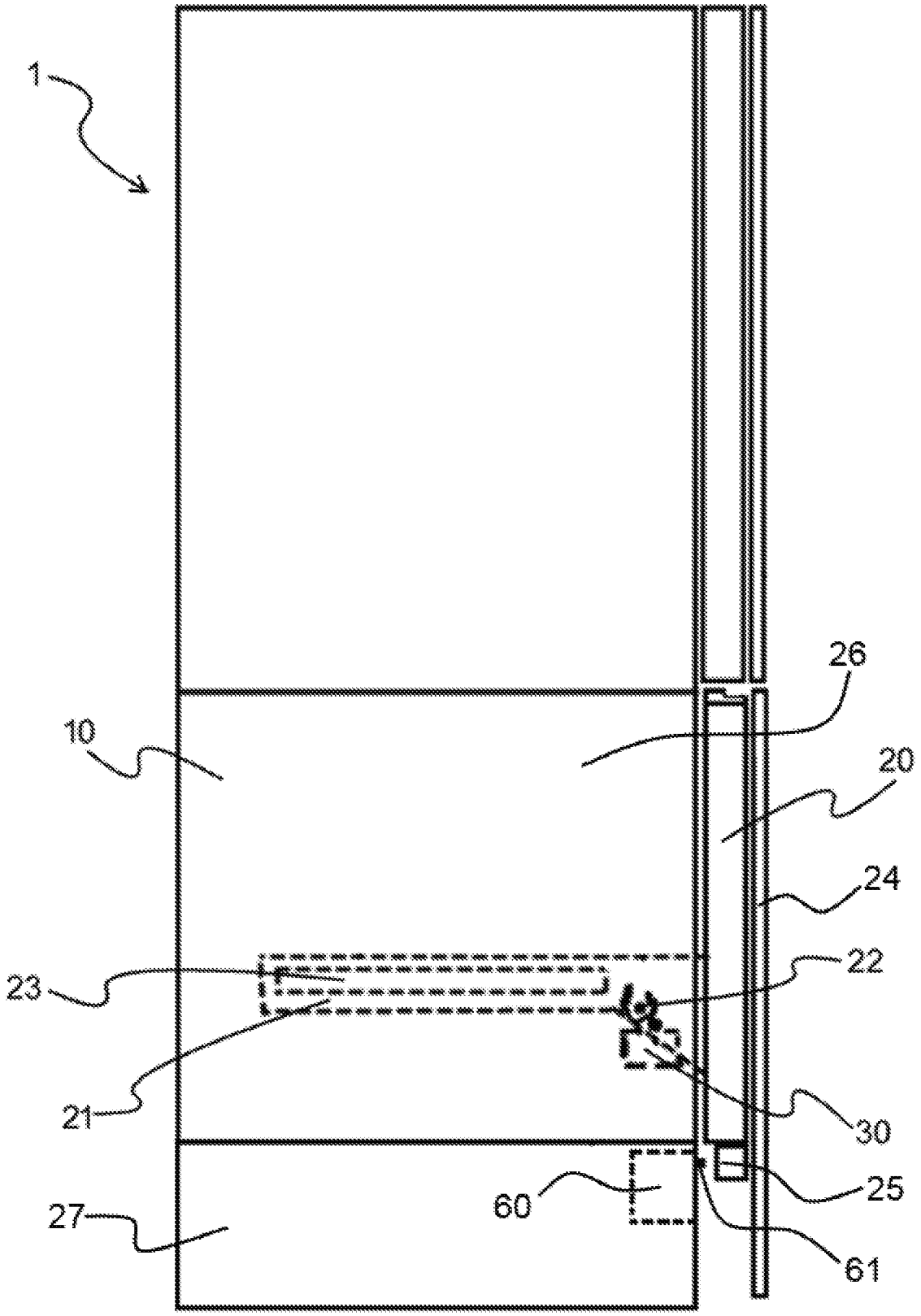
FIG. 1 is a representative, diagrammatic, side-elevational view of the cooling device according to the invention.
Figure 2:
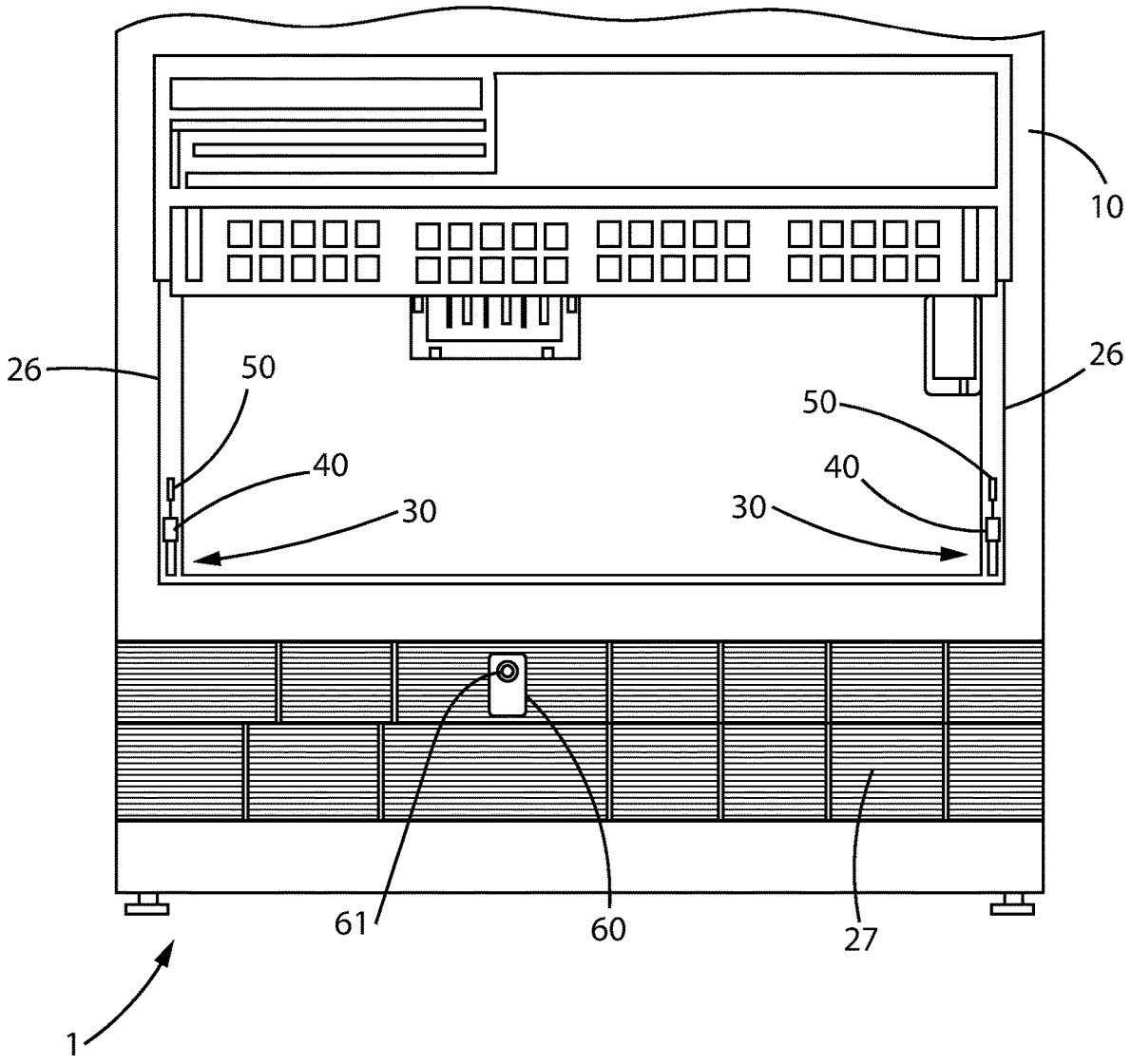
FIG. 2 is a representative, front-elevational view of a partial body and a compressor region of the cooling device according to the invention.
Figure 3:
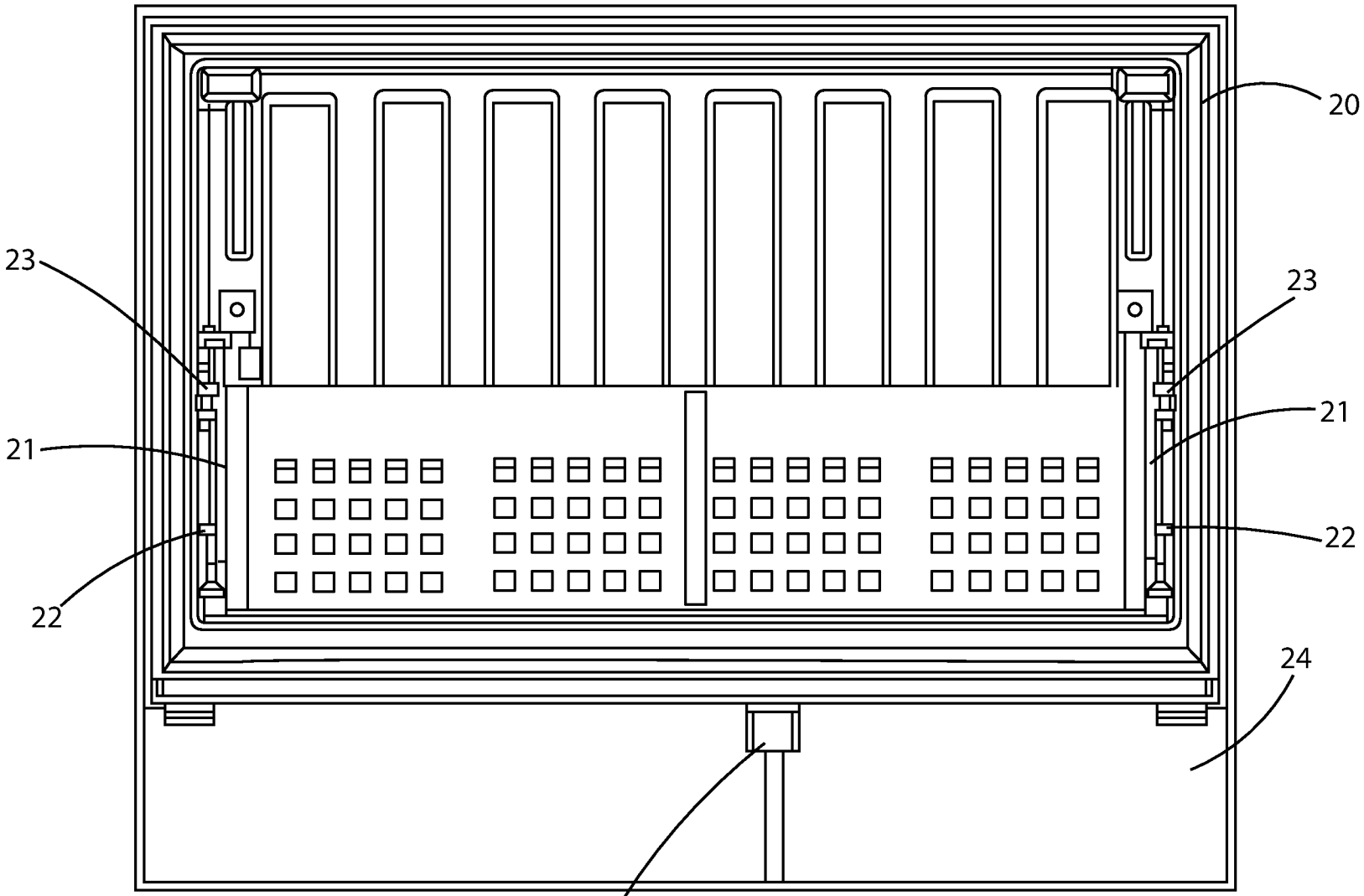
FIG. 3 is a representative, front-elevational view of a drawer door of the cooling device according to the invention.
Figure 4:
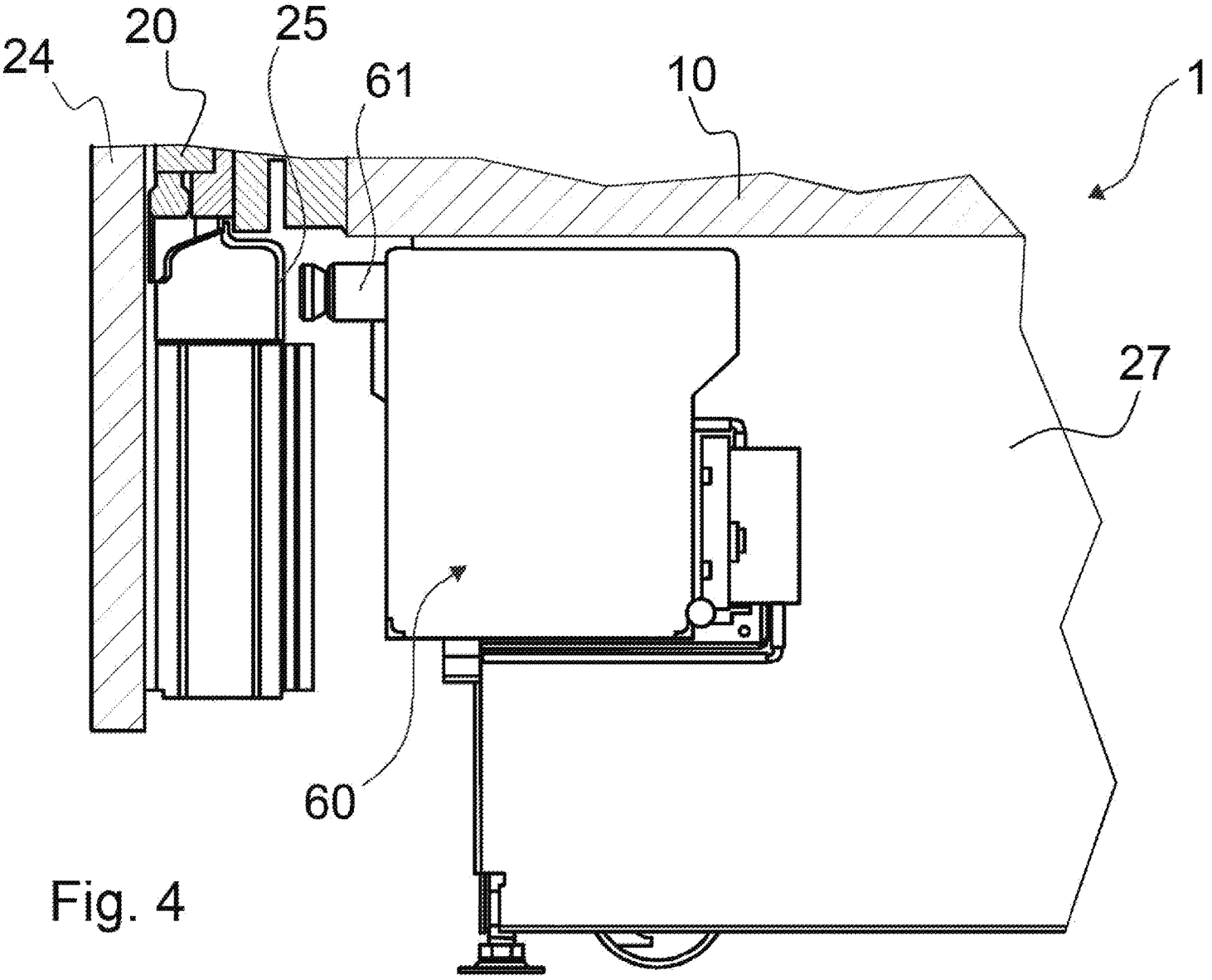
FIG. 4 is a representative, fragmentary, partially cross-sectional, side-elevational view of the drawer door and the compressor region of the cooling device according to the invention.

Referring now in detail to the figures of the drawings, in which the cooling device is explained with reference to examples in order to make the subject more understandable without forming any restrictive effect, and first, particularly, to FIGS. 1-4 thereof, it is seen that the cooling device 1 according to the invention has a body 10 and a drawer door 20 connected to the body 10 by rails 23. The drawer door 20 has a decorative panel 24. There is at least one door opening assistant 60 provided for facilitating opening of the drawer door 20. The door opening assistant 60 is positioned on the body 10 and is configured in such a manner as to push the drawer door 20 by using a piston end 61. The piston end 61 contacts a pushing region 25 provided on the drawer door 20 to push the drawer door 20. The door opening assistant 60 is provided in a compressor region 27. Due to the positions and dimensions of air input and output regions in the compressor region 27, the door opening assistant 60 is positioned at such a location that the distances of the door opening assistant 60 with respect to two side walls 26 of the body 10 are different from each other.

There is one door closing assistant 30 provided at each of the two side walls 26 of the body 10. The door closing assistant 30 is configured in such a manner as to provide automatic closing of the drawer door 20 when the drawer door 20 arrives at a predetermined position.

Figure 5:
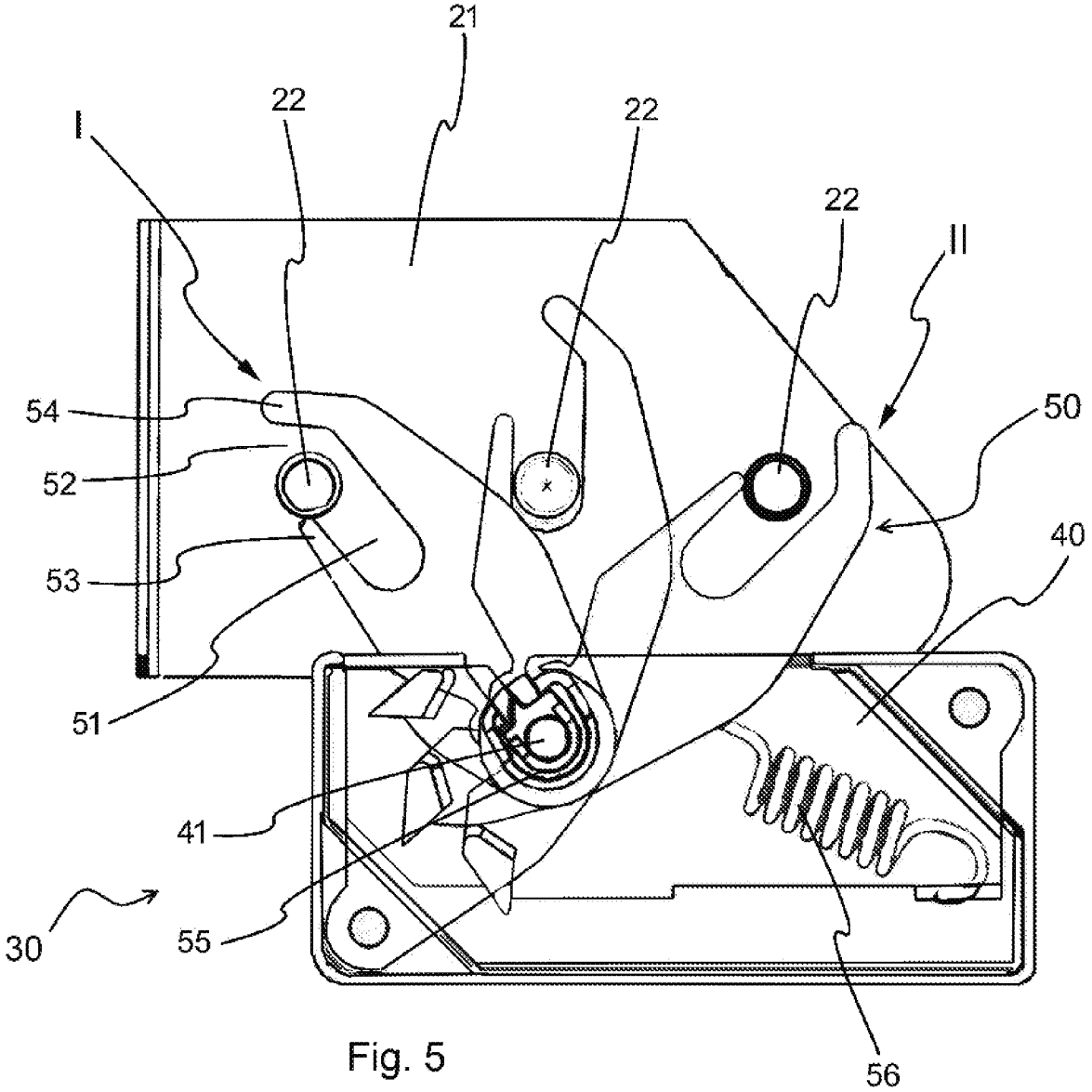
FIG. 5 is a representative, side-elevational view of the door closing assistant of the cooling device according to the invention with its three possible positions during rotation of the door closing assistant.

More details seen in FIG. 5 show that the door closing assistant 30 has a closing assistant body 40. There is a holder element 50 connected to the closing assistant body 40 by using a pin 41. The holder element 50 is connected to the closing assistant body 40 in such a manner as to be rotatable around an axis of the pin 41. The holder element 50 extends outwardly from the closing assistant body 40. There is a first arm 53 and a second arm 54 provided at a section of the holder element 50 which remains outside of the closing assistant body 40 or, in other words, away from the closing assistant body 40. The first arm 53 and the second arm 54 are provided for defining a housing or groove 51 in such a way that there is a predetermined distance therebetween. A section between the end sections of the first arm 53 and the second arm 54 is defined as an inlet 52. There is at least one cocking spring 55 provided in the vicinity of the pin 41 and connected to the holder element 50 from one end. The cocking spring 55 is configured in such a manner as to provide fixation of the holder element 50 when the holder element 50 arrives at a predetermined position I. On the other hand, there is at least one spring 56 connected to the closing assistant body 40 at one end and connected to the holder element 50 at the other end. The spring 56 draws the holder element 50 in such a manner as to try to release the holder element 50 from the position I fixed by the cocking spring 55 to another position II to close the drawer door 20.

As can be seen in FIG. 5, the holder element 50 is provided in such a way that the inlet 52 faces a catching pin 22 connected to the drawer door 20 at an open position I, while the drawer door 20 is pushed to be closed. The catching pin 22 is provided on a door carrier arm 21 providing a connection of the drawer door 20 to the body 10, especially to the rail 23. When the drawer door 20 is pushed slightly in order to be closed, the catching pin 22 passes through the inlet 52 and advances into the housing 51. Meanwhile, since the catching pin 22 pushes the second arm 54, the holder element 50 is released from the effect of the cocking spring 55 and the spring 56 draws the holder element 50 towards a closed position II. As the spring 56 draws the holder element 50, the first arm 53 pushes the catching pin 22 and provides movement of the drawer door 20 towards the closed position of the door. When it is desired to open the drawer door 20, the door opening assistant 60 pushes drawer door 20 and thus pushes the holder element 50 towards the open position I. Meanwhile, the force of the spring 56 is overcome in the door closing assistant 30, and the holder element 50 moves towards the open position I. The drawer door 20, which is opened as a result of the effect of the door opening assistant 60, stops before the holder element 50 arrives at the open position I. Afterwards, the user holds and opens the drawer door 20 and he/she brings the holder element 50 to the open position I and provides cocking of the cocking spring 55. If the user does not interfere with the drawer door 20 for a predetermined time duration, the effect of the door opening assistant 60 on the drawer door 20 is terminated. After that, the door closing assistant 30 is activated and it closes the drawer door 20 by using the spring effect.

Since the door closing assistant 30 is positioned in a symmetrical manner on both sides of the drawer door 20, the drawer door 20 is closed in a balanced manner. Moreover, since the door closing assistant 30 is provided in a symmetrical manner on both sides, unbalances, occurring during the effect of the door opening assistant 60 on the drawer door 20, are reduced. In other words, the drawer door 20 is opened and/or closed in a balanced manner.

The following is a summary list of reference numerals and the corresponding structure used in the above description of the invention.

REFERENCE SIGNS

1 Cooling device
10 Body
20 Drawer door
21 Door carrier arm
22 Catching pin
23 Rail
24 Decorative panel
25 Pushing region
26 Side wall
27 Compressor region
30 Door closing assistant
40 Closing assistant body
41 Pin
50 Holder element
51 Housing
52 Inlet
53 First arm
54 Second arm
55 Cocking spring

56 Spring
60 Door opening assistant
61 Piston end

The invention claimed is:

1. A cooling device, comprising:

a body;

a drawer door;

rails slidably attaching said drawer door to said body;

a door opening assistant facilitating opening of said drawer door;

at least two door closing assistants configured to close said drawer door when said drawer door reaches a predetermined position;

said at least two door closing assistants being disposed on at least one of said body or said drawer door permitting said door opening assistant to remain at a location between said at least two door closing assistants;

said drawer door having at least two door carrier arms linked to said rails and connected to said drawer door;

catching pins each being provided on a respective one of said at least two door carrier arms, permitting each of said catching pins to be held by a respective one of said at least two door closing assistants; and each of said at least two door closing assistants including at least one holder element for catching a respective one of said catching pins.

2. The cooling device according to claim 1, wherein said at least one holder element includes at least one first arm and at least one second arm extending and defining a housing therebetween having a size corresponding to said respective catching pin.

3. The cooling device according to claim 2, wherein one of said first arm or said second arm is longer than the other of said first arm or said second arm to facilitate insertion of said catching pin into said housing during at least one of opening or closing said drawer door.

4. The cooling device according to claim 1, wherein each of said at least two door closing assistants includes a respective closing assistant body and at least one pin connecting a respective holder element to a respective closing assistant body.

5. The cooling device according to claim 1, which further comprises at least one cocking spring for fixing said holder element at a predetermined open position.

6. The cooling device according to claim 1, which further comprises at least one spring for guiding said holder element to a predetermined closed position.

* * * * *